US007948191B2

(12) United States Patent
Chen et al.

(10) Patent No.: US 7,948,191 B2
(45) Date of Patent: May 24, 2011

(54) PARALLEL TRANSFORMER WITH OUTPUT SIDE ELECTRICAL DECOUPLING

(75) Inventors: Timothy Chen, Aurora, OH (US); James K. Skully, Willoughby, OH (US); Haiyan Wang, Richmond Heights, OH (US)

(73) Assignee: General Electric Company, Schenectady, NY (US)

( * ) Notice: Subject to any disclaimer, the term of this patent is extended or adjusted under 35 U.S.C. 154(b) by 428 days.

(21) Appl. No.: 12/252,759

(22) Filed: Oct. 16, 2008

(65) Prior Publication Data

US 2010/0097010 A1 Apr. 22, 2010

(51) Int. Cl.
*H05B 41/36* (2006.01)

(52) U.S. Cl. ..... 315/297; 315/277; 315/268; 315/246

(58) Field of Classification Search ..... 315/246, 315/268, 276, 277, 297, 291, 294, 316, 313, 315/329, DIG. 1, DIG. 5
See application file for complete search history.

(56) References Cited

U.S. PATENT DOCUMENTS

| | | | | |
|---|---|---|---|---|
| 6,323,603 | B1 * | 11/2001 | Persson | 315/290 |
| 6,459,214 | B1 | 10/2002 | Chen et al. | |
| 6,724,155 | B1 * | 4/2004 | Flory et al. | 315/289 |
| 7,193,368 | B2 * | 3/2007 | Chen et al. | 315/95 |
| 7,315,130 | B1 | 1/2008 | Chen et al. | |

* cited by examiner

*Primary Examiner* — Don P Le
(74) *Attorney, Agent, or Firm* — Fay Sharpe LLP

(57) ABSTRACT

A higher power package is provided in a smaller package by providing at least first and second magnetics in parallel in first and second transformers. To limit degrading performance associated with circulating current between the two transformers, the transformers are electrically decoupled. In a preferred embodiment, the circuit includes parallel primary and secondary windings of the transformer that are decoupled electrically on an output side. Particularly, diodes are provided in a preheat portion of the circuit so that once the preheat phase is terminated, the diodes prevent current flow in one direction through the preheat portion of the circuit.

18 Claims, 2 Drawing Sheets

PARALLEL TRANSFORMER WITH OUTPUT SIDE ELECTRICAL DECOUPLING

BACKGROUND OF THE DISCLOSURE

The present application relates to electronic lighting. It finds particular application in connection with providing electrical decoupling in lighting ballasts and will be discussed with particular reference thereto. It is to be appreciated, however, that the present application can also be used in other lighting applications, and is not necessarily limited to the aforementioned application.

There is an ever increasing demand in the lighting industry for smaller lighting packages. More particularly, there is a demand for increasingly higher power ballasts in smaller, more compact housings. Accordingly ballast designers, faced with this industry demand, must design ballasts to be smaller and have a greater power capacity.

Typically, electronic ballast designs use more than one magnetic component. The magnetic components can be for an electromagnetic interference (EMI) filter, for power factor correction, or for a ballast design that uses inductors and transformers. One magnetic component could also be used, but this approach is typically disfavored because the component would be relatively large. Thus, in order to reduce the overall size of the ballast, multiple magnetic components are used either in series, in parallel, or a combination of the two in both primary and secondary windings.

In the case where two transformers are situated in parallel in both the primary and secondary windings, circulating current will occur between the transformers if the electrical parameters of the windings are not matched exactly. That is, there is electrical interference with both the primary and secondary windings of the two transformers that are connected in parallel. As a result, the transformers will produce added heat, increase the possibility of overheating, and generally degrade the performance of the circuit.

Thus, a need exists for an improved electronic ballast design that includes at least two transformers that can be smaller, low profile components that effectively handle higher power and high current, and which allow the two transformers that are connected in parallel to be effectively decoupled so that the primary and secondary windings do not cause circulating current between the two transformers.

SUMMARY OF THE DISCLOSURE

A ballast circuit includes first and second lamps disposed in parallel relation, and first and second transformers disposed in parallel for providing power to the first and second lamps, respectively. An electrical decoupling assembly electrically decouples the first and second transformers after a preheat phase of lamp ignition is complete.

A method of improving lamp performance in a multi-transformer lamp ballast circuit includes providing first and second transformers, and electrically decoupling the first and second transformers after a preheat phase of operation has been completed.

A primary advantage is the ability to develop a high power ballast package that is smaller and more compact than single transformer arrangements by effectively coupling at least first and second transformers together and electrically decoupling portions of the circuit after the preheat phase of operation.

DETAILED DESCRIPTION OF THE PREFERRED EMBODIMENTS

Figure 1:
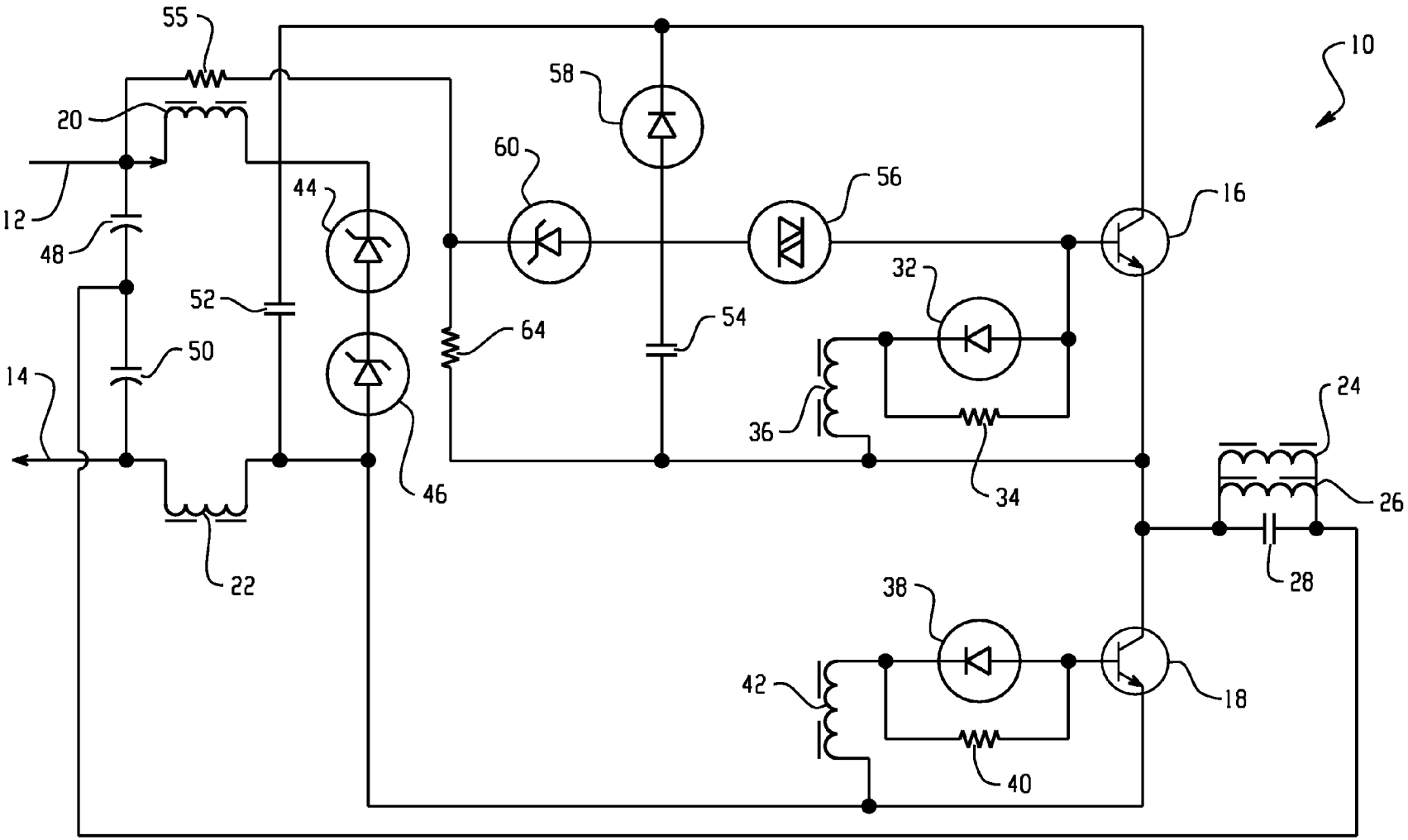
FIG. 1 is a schematic diagram of a first portion of a ballast topography of the present disclosure.

With reference now to FIG. 1, a detailed circuit diagram or ballast 10 is shown. The circuit shown is based on a half bridge rectified current fed topology. Other topologies are also contemplated, such as a full wave rectified input signal. The input signal is applied across a positive bus rail 12 and a negative bus rail 14. The circuit 10 includes transistor switches 16, 18, which alternate periods of conductivity. That is, when transistor 16 is conductive, transistor 18 is non-conductive, and vice-versa. The transistors 16, 18 are preferably bipolar junction transistors (BJTs) in the illustrated embodiment, but it is to be understood that field effect transistors (FETs) or other appropriate switching devices are also contemplated. Generally, the transistors 16, 18 are connected in series between the positive bus rail 12 and the negative bus rail 14 via a current transformer configured by inductors 20, 22. The inductors 20, 22 are provided to regulate or moderate current. The inductors 20, 22 allow the transistors 16, 18 to see a substantially DC signal with a small amount of AC ripple. The inductor 20 is located on the positive bus rail 12 while the inductor 22 is located on the negative bus rail 14.

Resonant inductors 24, 26 are situated in parallel with one another, and connected between the transistors 16, 18. Together with a resonant capacitor 28, disposed in parallel relation with the resonant inductors, the resonant inductors 24, 26 help define a resonant frequency of the ballast 10. The transistor 16 is driven by gate drive circuitry that includes a diode 32, a resistor 34 and an inductor 36. The transistor 18 is driven by similar gate drive circuitry that includes a diode 38, a resistor 40 in parallel with the diode, and an inductor 42.

High power, high voltage diodes 44, 46 protect the transistors 16, 18 during a transient state. If one of the lamps should be removed from the ballast, or otherwise fails in some other manner, the remaining lamp or lamps will still see the same voltage during a preheating phase. Capacitors 48, 50 are placed in series between the positive bus rail 12 and the negative bus rail 14 and serve to clamp the ballast voltage to the bus voltage. A capacitor 52, in parallel with the diodes 44, 46, and serves to smooth ripple in the DC input signal. When input power is applied, the capacitor 54 is charged through the resistor 55 and diode 60. When the voltage across the capacitor 54 exceeds the breakdown voltage of a diode for alternating current or diac 56, a large change in current is applied to the base winding 36 of the transistor 16. This initiates oscillation. A diode 58 discharges the capacitor 54 when the transistor 16 is on, or conductive. A resistor 64 is connected to a node between the two switches 16, 18 and the DC path then continues through the windings of the primary transformer and back to the DC source.

Figure 2:
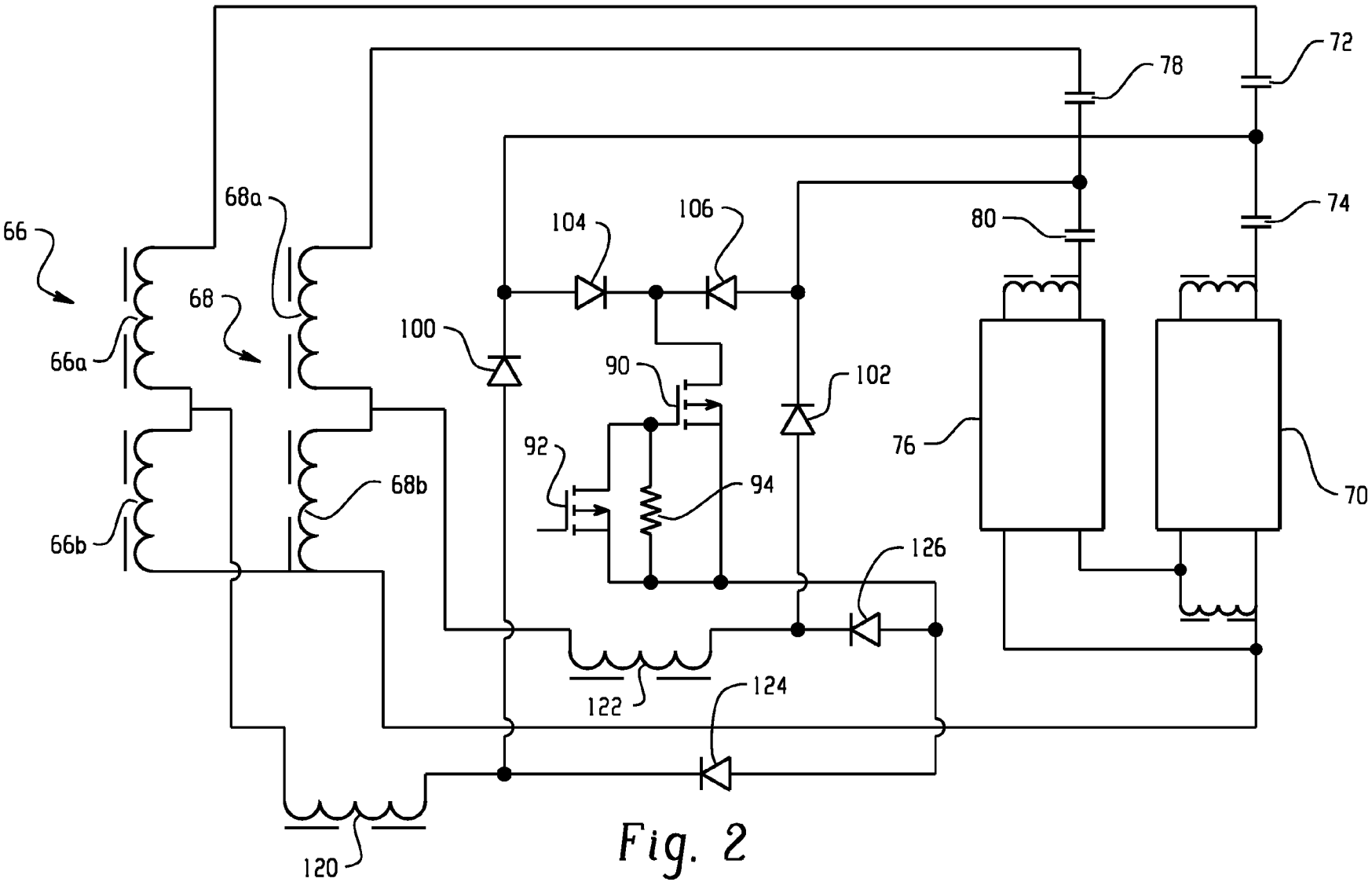
FIG. 2 is a schematic diagram of a second portion of the ballast topography of the present disclosure.

With reference now to FIG. 2, and continuing reference to FIG. 1, the power transformers, of which the primary side includes the resonant inductors 24, 26, also includes inductors 66, 68 on the secondary side, coupled to the primary inductors 24, 26. Inductor 66 of the first transformer provides power to a first lamp 70 through first and second capacitors 72, 74 that are disposed in series and similarly the secondary winding or inductor 68 of the second transformer provides power to a second lamp 76 through first and second capacitors 78, 80 that are disposed in series. As will be appreciated, additional lamps can be placed in parallel with the first and second lamps 70, 76 if additional lamps are desired.

A transistor 90 turns conductive during a pre-heat phase of the lamp operation. When the transistor 90 is conductive, the voltage that the lamps 70, 76 see during the pre-heating phase is reduced. When pre-heating is complete, the transistor 90 is turned off, ramping up the voltage to ignite the lamps 70, 76.

A transistor 92 is connected to the gate of the transistor 90. The transistor 92, in turn, is gated by a timing circuit (not shown). The timing circuit is configured to provide an optimal pre-heat delay, typically of about 0.3 to 0.5 seconds, from when current is applied to the striking of the lamps 70, 76. Once the timing circuit is charged, the gate voltage to the transistor 90 is reduced, turning it non-conductive. This opens the switch 90 (turns the switch 90 off) and removes the pre-heat current from the lamps 70, 76 and boosts the voltage up to strike the lamps. The resistor 94 serves as a voltage divider whose value can be selected to assist in lowering the voltage to the gate of transistor 90.

Voltage from the secondary windings 66, 68 of the first and second transformers passes through several diodes 100, 102, 104, 106. The diodes 100, 102, 104, 106 cooperate with the switches 90, 92 and the resistor 94 form a preheat portion of the circuit. These diodes are interconnected between the capacitor pairs 72, 74 and 78, 80. This diode and capacitor arrangement provides a buffering, decoupling operation which permits each individual lamp to be operated separately without interference due to removal, de-lamping, or failure of other lamps during steady state operation of the lamps 70, 76. Thus, between this buffering network, and the voltage clamp 44, 46 in the ballast 10, first or upper sides of the lamps 70, 76 are protected from lamp removal and failure in both pre-heat and steady state modes.

The primary windings 24, 26 of the two transformers are connected in parallel and then in parallel with the resonant capacitor 28. On the secondary side, since a smaller package is required and a single magnetic is physically too large, the present disclosure employs smaller magnetics. Here there are two windings on the secondary side, 66, 68, and the windings could be placed in series or parallel in an effort to reduce the size. As shown, the two secondary side windings 66, 68 of the two transformers are placed in parallel and each winding includes portions disposed in series, i.e., a first or upper winding portion 66*a* in series with a second or lower winding portion 66*b*, and likewise, a first or upper winding portion 68*a* in series with a second or lower winding portion 68*b*. Since the magnetics are not perfectly matched, there is a difference on the secondary side of the two transformers that results in energy being circulated on the secondary side. This energy circulation degrades performance, for example, causing overheating of the magnetics. Thus, there is a need to decouple the secondary side. The secondary side or secondary (lower) windings 66*b*, 68*b* of the two transformers are commonly connected on the bottom side. During the preheat stage when the transistor or switch 90 is turned on, part of the energy flows through each of the preheat cathode windings 120, 122 and connects in the center of the secondary windings. More particularly, current flows from preheat cathode winding 120 (122), through the secondary winding 66*a* (68*a*), through capacitor 72 (78), through diode 104, then through switch 90, to diode 124, and completes the loop with the preheat cathode winding 120 (all of the parenthetical reference numerals identify the components in the parallel circuit associated with the second transformer and second lamp). Once the preheat stage is over or terminated, the switch 90 is opened. In the center, two preheat cathode windings 120, 122 from the same cathode-heating transformer are decoupled by the diodes 124, 126 after the preheat phase is terminated. There is no desire for further current passing through this preheat portion of the circuit and the diodes 124, 126 serve this function of decoupling the center of the secondary windings. Further, during the preheating phase the preheat cathode windings 120, 122 provide electrical buffering for the center windings. Opening the switch 90 (i.e., turning off the switch 90), results in the preheat function being removed from the lamp circuit. However, since the connections between the preheat portion, the transformers and lamps are still in place, it becomes necessary to decouple the cathode windings and secondary windings of the transformers after the preheat phase. Specifically, but for the diode 124, 126 current would want to flow from the first cathode winding 120, through the secondary winding 66*a* of the second transformer to capacitor 72, then to capacitor 74, through first lamp 70, through lamp 76, capacitor 80, capacitor 78 to the secondary winding 68*a*, to the second cathode winding 122 whereby diode 126 blocks the current. A similar path would be possible by starting with the second cathode winding and whereby the diode 124 would block the current. Thus, it is evident that the diodes 124, 126 effectively decouple the cathode windings at the centers of the secondary windings of the transformers.

The top windings 66*a*, 68*a* are connected to capacitors 72, 78, respectively. The capacitors 72, 78 provide the electrical decoupling for the top portions of the secondary windings. Each of two secondary windings shares current determined by capacitors 72, 78, respectively, if two lamps (70, 76) are connected. If only one lamp is connected, of course only the winding connected with the connected lamp has the secondary current.

With this arrangement, the circuit uses two smaller low profile magnetics to handle higher power/high current such T5 54 or T5 80 watts lamps. It will be appreciated that the use of the diodes or capacitors to electrically decouple the secondary windings can be reversed, i.e., the diodes could be used in association with the first or top ends of the lamps and the capacitors used in association with the second or lower ends of the lamps without departing from the scope and intent of the present disclosure.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A ballast circuit comprising:

at least first and second lamps disposed in parallel relation;

first and second secondary windings of first and second transformers, respectively, disposed in parallel for providing power to the first and second lamps, respectively; and an electrical decoupling assembly that electrically decouples the first and second secondary windings of the transformers after a preheat phase of lamp ignition is complete.

2. The ballast circuit of claim 1 wherein the decoupling assembly is positioned in the circuit to electrically decouple output sides of the secondary windings of the transformers operatively associated with the first and second lamps, respectively.

3. The ballast circuit of claim 2 wherein the decoupling assembly includes first and second diodes interposed between the first and second lamps, respectively, and the first and second transformer windings, respectively.

4. The ballast circuit of claim 1 further comprising first and second capacitors located between the other of the first and second winding portions, respectively, and the first and second lamps, respectively.

5. The ballast circuit of claim 1 wherein first and second diodes are operatively disposed between a preheat circuit portion and first and second preheat cathode windings, respectively.

6. The ballast circuit of claim 5 wherein the first and second preheat cathode windings are operatively connected with center portions of first and second secondary windings of the first and second transformers.

7. The ballast circuit of claim 6 wherein second ends of the first and second lamps are operatively connected with the secondary windings, and the center portions of the first and second secondary windings are connected with each other through a preheat portion of the circuit.

8. The ballast circuit of claim 7 wherein the first and second diodes each preclude current flow from the center portions in one direction after lamp ignition.

9. The ballast circuit of claim 1 wherein the first and second transformers are connected with each other through a preheat portion of the circuit, and first and second diodes each preclude current flow from the center portions in one direction after preheat is complete.

10. The ballast circuit of claim 9 wherein the first and second diodes are interposed between a switch in the preheat portion of the circuit and the first and second transformers.

11. The ballast circuit of claim 10 further comprising first and second capacitors interposed between the first and second transformers and the first and second lamps, respectively.

12. A method of improving lamp performance in a multi-transformer lamp ballast circuit comprising:

providing first and second transformers; and electrically decoupling the first and second transformers after a preheat phase of operation has been completed.

13. The method of claim 12 wherein the decoupling step includes positioning diodes in a preheat portion of the circuit to decouple the transformers.

14. The method of claim 13 further comprising providing capacitors between a lamp and a respective transformer.

15. The method of claim 12 further comprising providing a capacitor between a lamp and a respective transformer.

16. The method of claim 12 further comprising placing the first and second transformers in parallel and connecting a preheat portion to a center portion of the transformers.

17. The method of claim 16 wherein the decoupling step includes positioning diodes in the preheat portion of the circuit to decouple the transformers.

18. The method of claim 17 further comprising providing a capacitor between a lamp and a respective transformer.

* * * * *